US007083549B1

(12) United States Patent
Fan

(10) Patent No.: US 7,083,549 B1
(45) Date of Patent: Aug. 1, 2006

(54) STEPPER FITNESS MACHINE

(75) Inventor: Jeeng-Neng Fan, Taoyuan (TW)

(73) Assignee: Hsin Lung Accessories Co., Ltd., Hsin-Chu Hsien (TW)

( * ) Notice: Subject to any disclaimer, the term of this patent is extended or adjusted under 35 U.S.C. 154(b) by 0 days.

(21) Appl. No.: 11/110,823

(22) Filed: Apr. 21, 2005

(51) Int. Cl.
*A63B 22/04* (2006.01)
*A61H 15/00* (2006.01)

(52) U.S. Cl. ..... 482/52; 601/132

(58) Field of Classification Search ..... 482/51–53, 482/57, 62, 70, 148; 601/36, 132
See application file for complete search history.

(56) References Cited

U.S. PATENT DOCUMENTS 3,899,115 A * 8/1975 Simjian ..... 601/132
3,915,159 A * 10/1975 Simjian ..... 601/132
3,945,637 A * 3/1976 Simjian ..... 482/62
4,796,882 A * 1/1989 Jiumr ..... 482/57
5,411,454 A * 5/1995 Chang ..... 482/53
6,623,406 B1 * 9/2003 Wu ..... 482/51
6,918,856 B1 * 7/2005 Chang ..... 482/51

* cited by examiner

*Primary Examiner*—Stephen R. Crow
(74) *Attorney, Agent, or Firm*—Troxell Law Office, PLLC

(57) ABSTRACT

The present invention describes a stepper fitness machine that includes a base as its main body, a handle installed on the base, and a pair of pedal transmission mechanisms pivotally coupled to the base and moves reciprocally up and down. The foregoing components constitute the main body of the stepper fitness machine for an exerciser to simulate stepping and treading movements. A linked handlebar is pivotally coupled to the base and driven by two pedal transmission mechanisms to swing the linked handlebar rapidly back and forth, and a massage belt is installed on the linked handlebar and provided for the exerciser to wear, such that high-speed vibrations and massages are produced on the exerciser's body where the massage belt is worn.

9 Claims, 5 Drawing Sheets

STEPPER FITNESS MACHINE

BACKGROUND OF THE INVENTION

1. Field of the Invention

The present invention relates to fitness equipments, and more particularly to a stepper fitness machine that provides simulated stepping and treading exercises for exercisers and eliminates fats accumulated at a certain part of the exerciser's body by high-speed vibrations.

2. Description of the Related Art

In general, working people usually do not have much time for exercises in their busy life, and thus their body functions are ageing and deteriorated gradually, and even may have a fatal breakdown known as "Karoshi", which refers to the death from overwork. It is important for us regardless of employers or employees to prioritize our life with more emphasis on the balance between work and rest.

Further, outdoor activities are restricted by various factors including weather, place, and thus outdoor activities cannot be uncontrolled or arranged most of the time. Therefore, indoor fitness equipments become popular and are used extensively by people for fitness exercises nowadays, and these indoor fitness equipments including treadmills, bikes and steppers are usually designed to simulate the movements of outdoor sports and activities.

However, traditional steppers can only simulate the stepping and treading movements for both legs. Since such movements are monotonous, people will lose their interest in the machine easily, particularly for single function fitness machines which limit exercises for certain specific parts of the exerciser's body. Such machine not only limits the exercise functions, but also causes excessively developed muscles in certain part of the body, which becomes a drawback on our figure and cannot meet our fitness requirements.

SUMMARY OF THE INVENTION

The primary objective of the present invention is to provide a stepper fitness machine that comprises a base as its main body, a handle installed on the base, and a pair of pedal transmission mechanisms pivotally coupled to the base and moving reciprocally up and down. The foregoing components constitute the main body of the stepper fitness machine for simulating a stepping and treading movement; wherein a linked handlebar is pivotally coupled to the base and driven by two pedal transmission mechanisms to swing the linked handlebar rapidly back and forth, and a massage belt is installed on the linked handlebar and provided for an exerciser to wear, such that high-speed vibrations and massages are produced at position where the massage belt is worn.

DETAILED DESCRIPTION OF THE PREFERRED EMBODIMENTS

To make it easier for our examiner to understand the present invention, the following detailed description with reference to the accompanying drawings of an embodiment are given for example, but such preferred embodiment is not intended to limit the scope of the present invention.

Figure 1:
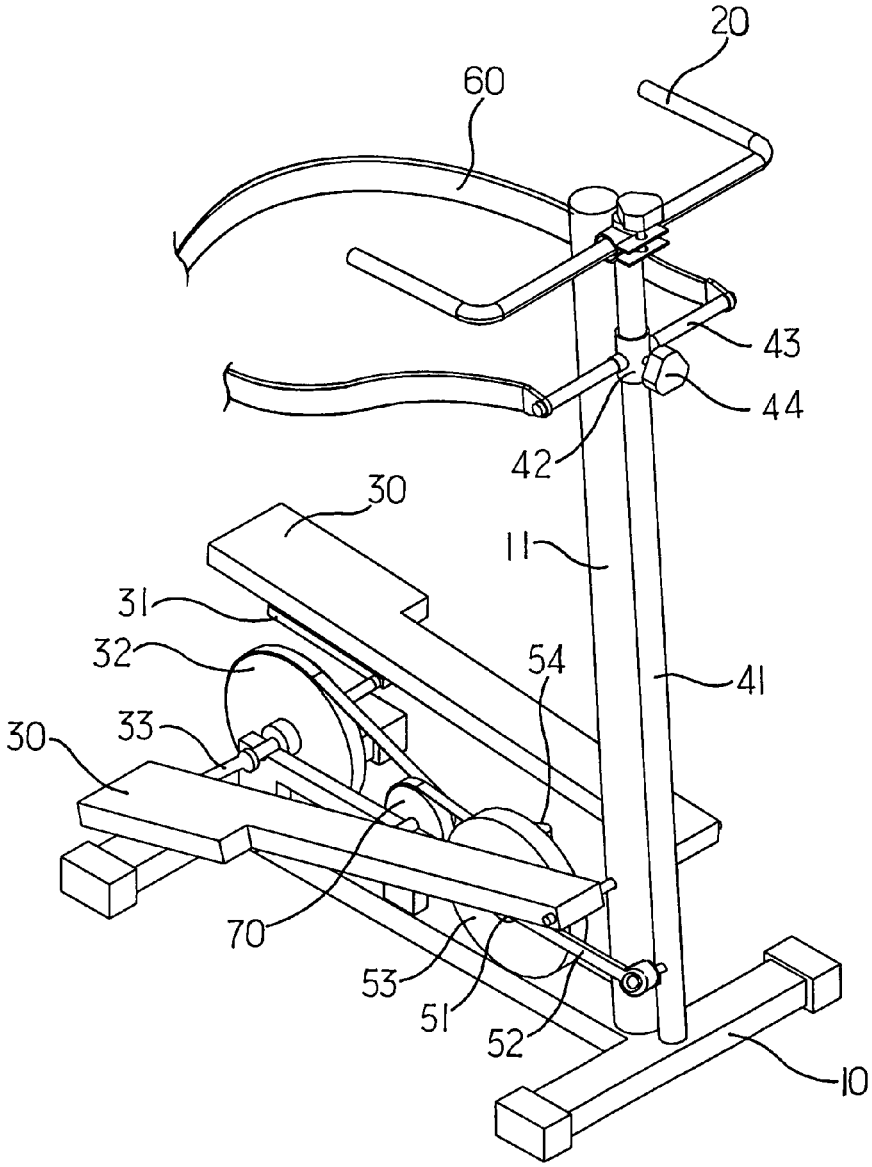
FIG. 1 is a perspective view of a stepper fitness machine in accordance with the present invention.

Referring to FIG. 1, a basic structure of a stepper fitness machine in accordance with the present invention is illustrated. The stepper fitness machine of the invention comprises a base 10, a linked handlebar 20 disposed vertically on the base 10, and a pair of pedal transmission mechanisms 30 pivotally coupled to the base 10 and moving reciprocally up and down. The foregoing components constitute the main body of the stepper fitness machine provided for an exerciser to simulate the stepping and treading movements.

Figure 5:
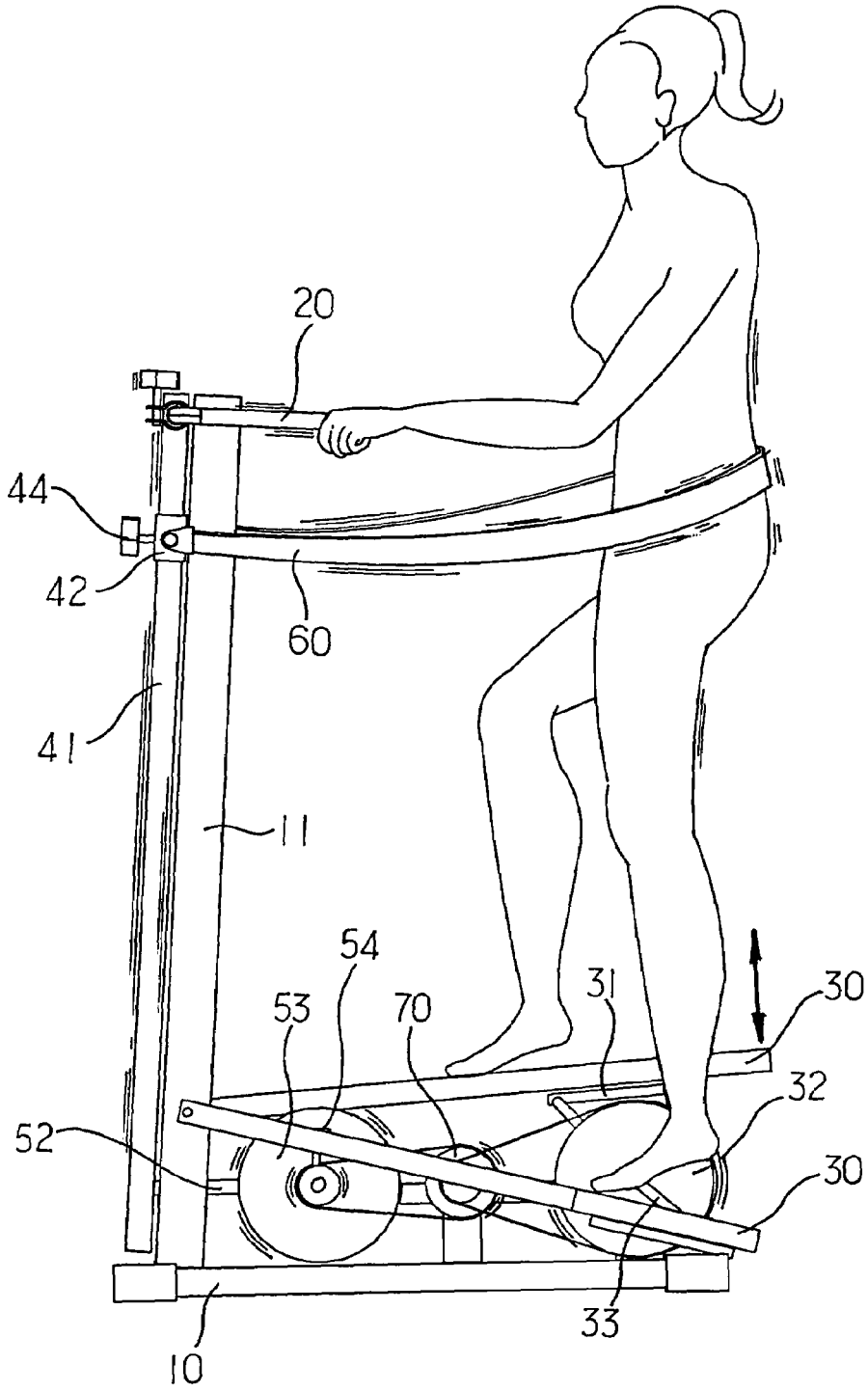
FIG. 5 is a schematic view of the operation of the present invention.

A linked handlebar 11 is pivotally coupled to the base 10 and driven by two pedal transmission mechanisms 30 to swing the linked handlebar 41 rapidly back and forth, and a transversal bar 43 is disposed on both sides of the link handlebar 41 separately, and a massage belt 60 is installed on the linked handlebar 41 and provided for an exerciser to wear by connecting both ends of the massage belt with the transversal bar 43 as shown in FIG. 5. Therefore, the exerciser can step on the pedal transmission mechanisms 30 to work out on the simulated stepping and treading exercises. In the meanwhile, high-speed vibrations and massages are produced by the massage belt 60 driven by the reciprocal movements of the linked handlebar 41 on the exerciser's body where the massage belt 60 is worn.

Figure 2:
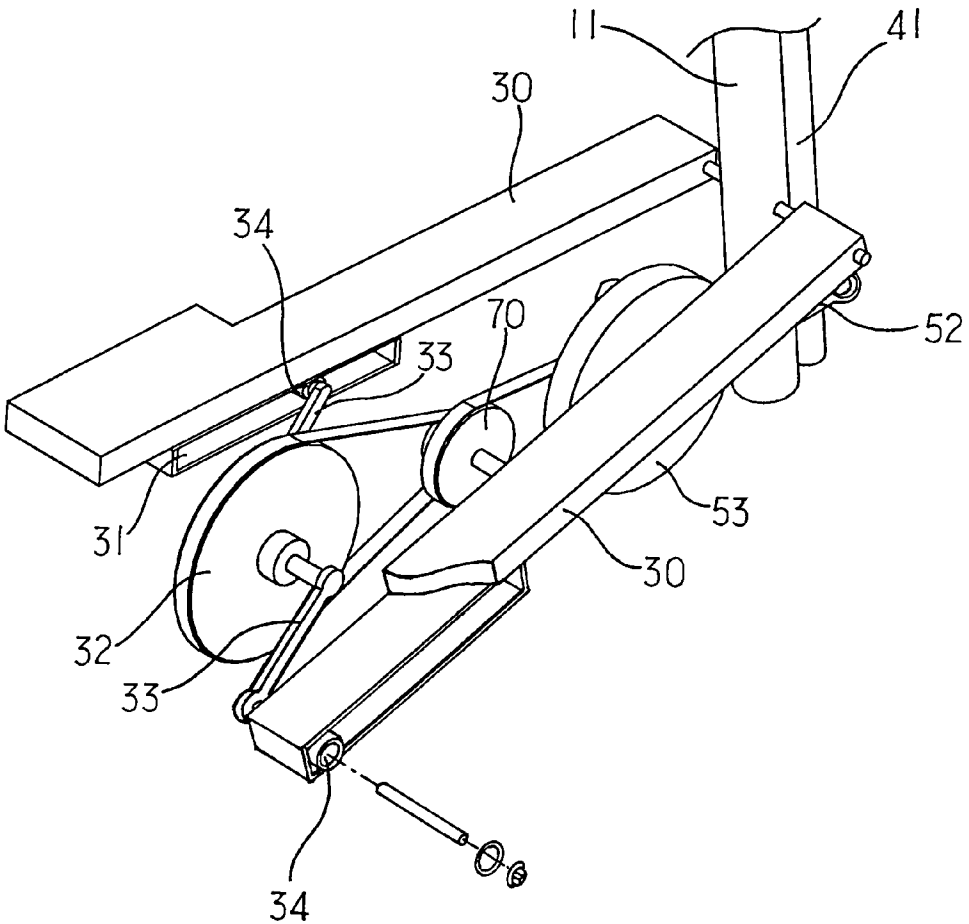
FIG. 2 is a perspective view of disassembled parts of a pedal transmission mechanism and a flywheel according to the present invention.

Referring to FIGS. 1 and 2, a vertical rod 11 is disposed vertically at a front end of the base 10, and a front end of the two pedal transmission mechanisms 30 is pivotally and separately coupled to both sides of the vertical rod 11, and a linked handlebar 20 is installed at the top of the vertical rod 11 for an exerciser to grip with both hands. The top of the linked handlebar 41 is pivotally coupled with the vertical rod 11. Further, the base 10 has an eccentric axle 51 axially coupled thereon and rotated by the movement of the two pedal transmission mechanisms 30, and a link rod 52 is connected between the eccentric axle 51 and the bottom of the linked handlebar 41 to facilitate the transmission through the eccentric axle 51 and the link rod 52 to constitute the reciprocal movements of the linked handlebar 41.

In an application of this embodiment, the rear ends of the two pedal transmission mechanisms 30 are extended towards the rear of the base 10, and the base 10 has a flywheel 32 axially installed in the middle of the rear ends of the two pedal transmission mechanisms 30 and constitutes a transmission with the eccentric axle 51. The surface on both sides of the flywheel 32 has a branch rod 33 axially coupled thereon, and each rear end of the two pedal transmission mechanisms 30 has a sliding groove 31 for engaging the branch rod 33. A sleeve 34 is installed in the area between the two branch rods 33 and the sliding groove 31 of the pedal transmission mechanisms 30, such that the two pedal transmission mechanisms 30 individually drives the connected branch rod 33 to rotate in the same rotary direction of the flywheel 32 so as to achieve the effect of driving the rotation of the flywheel 32 and also rotating the eccentric axle 51 through a transmission.

Figure 3:
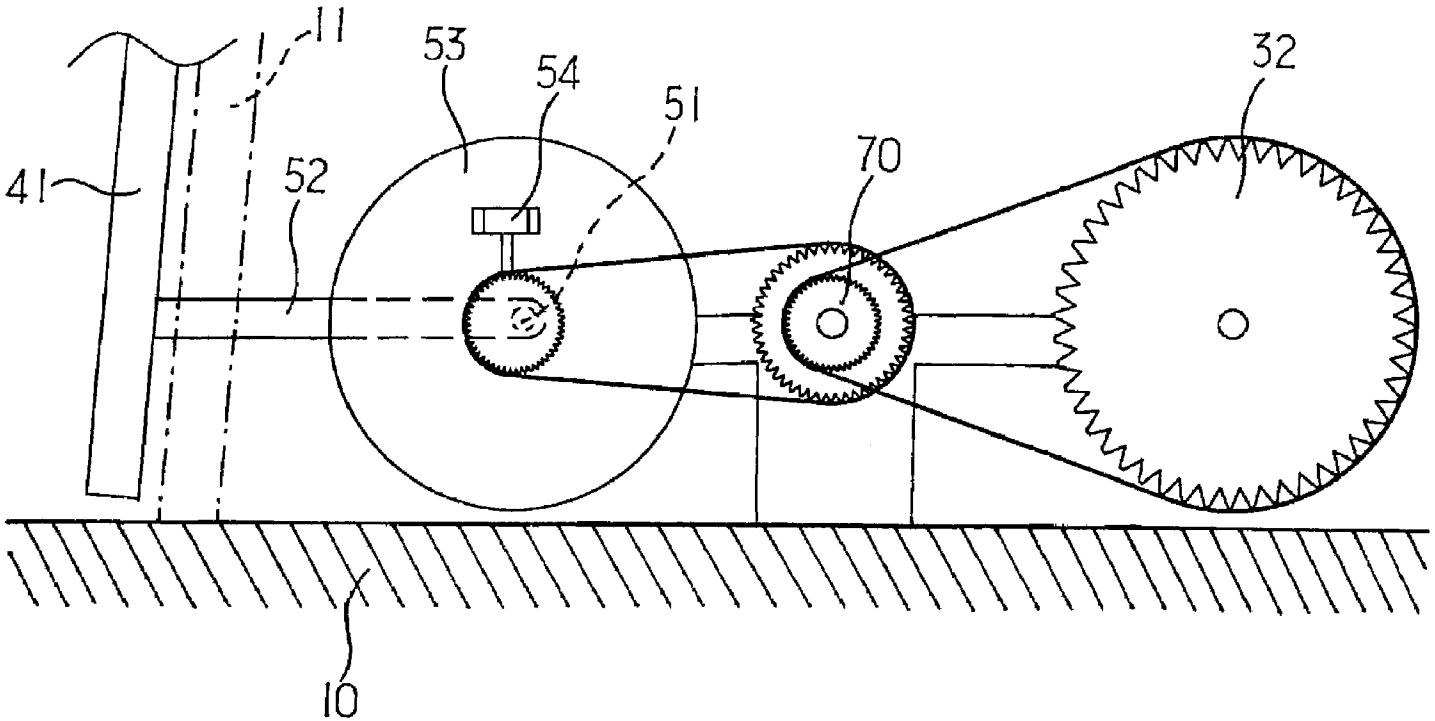
FIG. 3 is a schematic view of a transmission among a flywheel, an idle wheel and a revolving wheel according to the present invention.

Referring to FIGS. 1 and 3, the base 10 has a revolving wheel 53 disposed at a rear side of the vertical rod 11, and the eccentric axle 51 is axially disposed on a wheel surface of the revolving wheel 53, and a resistance member 54 is installed on another lateral side of the revolving wheel 53 for controlling the rotary capability of the revolving wheel 53, so that a user can change the rotary capability of the flywheel 53 through the resistance member 54 and achieve the purpose of adjusting the resistance level for exercises.

Figure 4:
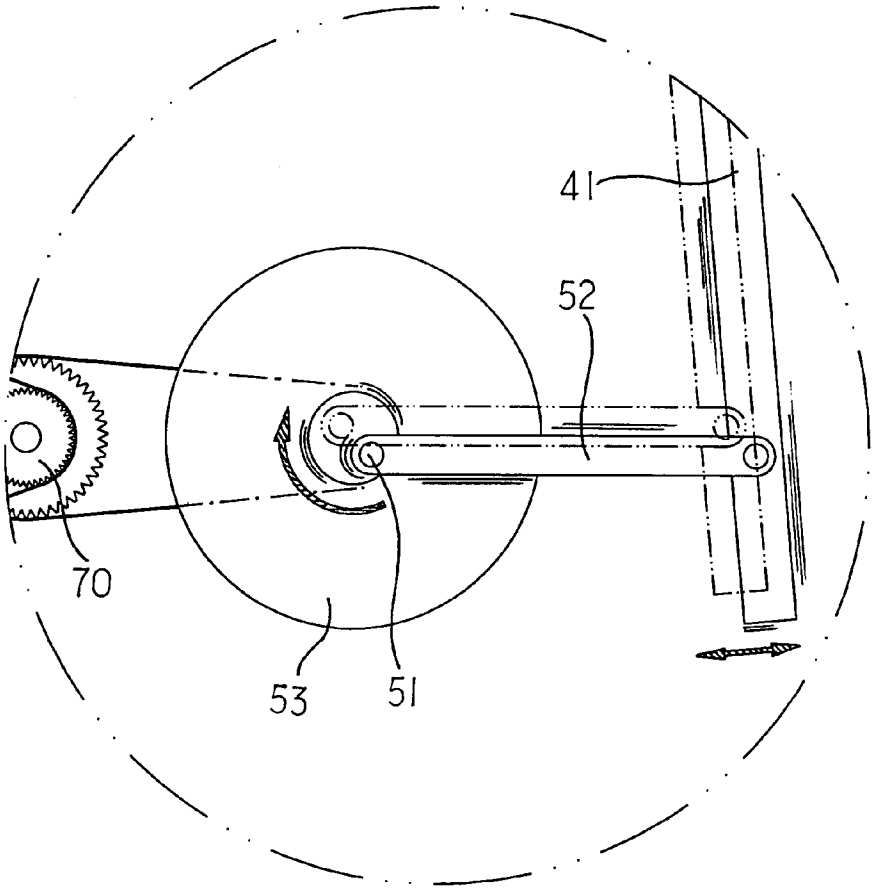
FIG. 4 is a schematic view of the movements of a linked handlebar according to the present invention.

Referring to FIGS. 3 and 4, an idle wheel 70 is axially connected between the flywheel 32 and the revolving wheel 53, and the flywheel 32, idle wheel 70 and the revolving wheel 53 can be driven by the transmission through a sprocket and a chain or through a belt (not shown in the figure). The number of revolutions of the eccentric wheel 51 can be increased by changing the gear ratios among the flywheel 32, idle wheel 70 and the revolving wheel 53 to drive the linked handlebars 41 to vibrate with a high speed and improve the effect of eliminating fats by the vibrations.

Further, the fitness machine of the invention as shown in FIG. 1 has a sheath 42 installed on the linked handlebar 41, and the sheath 42 is secured onto the linked handlebar 41 by a bolt 44. The aforementioned transversal rod 43 for connecting the massage belt 60 is installed on both sides of the sheath 42, so that users can change the position of the sheath 41 on the linked handlebar 41 to adjust the message belt 60 to a desired height, which further improves the functions of the whole fitness machine.

In summation of the description above, the present invention provides a better operable indoor fitness machine that complies with the patent application requirements. The description and its accompanied drawings are used for describing preferred embodiments of the present invention, and it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A stepper fitness machine, including a main structure comprised of a base, a linked handlebar installed on said base, a pair of pedal transmission mechanisms pivotally coupled to said base and moving reciprocally up and down for an exerciser to simulate a stepping and treading movement, characterized in that: said base has a linked handlebar pivotally coupled thereon, and said linked handlebar is driven by said pair of pedal transmission mechanisms to move reciprocally and rapidly, and a massage belt is installed at said linked handlebar and provided for said exerciser to wear, such that a high-speed vibration and a massage effect are produced on the body of said exerciser where said massage belt is worn.

2. The stepper fitness machine of claim 1, wherein said base comprises a vertical rod vertically disposed at a front section of said base, and front ends of said two pedal transmission mechanisms are pivotally and separately coupled to both sides of said vertical rod, and a top section of said linked handlebar is pivotally coupled with said vertical rod, and an eccentric axle is axially coupled on said base and driven by said two pedal transmission mechanisms to rotate, and a link rod is coupled between said eccentric axle and the bottom of said linked handlebar, such that said linked handlebar moves reciprocally by a transmission of said eccentric axle and said link rod.

3. The stepper fitness machine of claim 2, wherein said two pedal transmission mechanisms have their rear ends extended towards a rear side of said base, and a flywheel is axially coupled to the middle of rear ends of said two pedal transmission mechanisms to create a transmission with said eccentric axle, and a branch rod is axially coupled on a wheel surface on both sides of said flywheel, and a sliding groove is disposed at rear ends of said two pedal mechanism for connecting said branch rod, such that said two pedal transmission mechanism moves up and down to drive said branch rod to rotate in the same rotary direction of said flywheel and achieve the effect of rotating said flywheel, and said eccentric axle is rotated through said transmission.

4. The stepper fitness machine of claim 2, wherein said base comprises a revolving wheel axially coupled to a rear side of said vertical rod, and said eccentric axle is axially coupled to a wheel surface of said revolving wheel, and a resistance member is disposed on a side of said revolving wheel for controlling the rotary capability of said revolving wheel.

5. The stepper fitness machine of claim 3, wherein said base comprises a revolving wheel axially coupled to a rear side of said vertical rod, and said eccentric axle is axially coupled to a wheel surface of said revolving wheel, and an idle wheel is axially disposed between said flywheel and said revolving wheel.

6. The stepper fitness machine of claim 5, wherein said flywheel, said idle wheel and said revolving wheel are linked and transmitted by a belt or a chain.

7. The stepper fitness machine of claim 2, wherein said linked handlebar has a transversal rod transversally disposed on both sides, and both ends of said message belt are coupled with said two transversal rods respectively.

8. The stepper fitness machine of claim 2, wherein said linked handlebar has a sheath secured onto said linked handlebar by a bolt, and both ends of said message belt are fixed to said sheath on said transversal rod.

9. The stepper fitness machine of claim 2, wherein said linked handlebar has a sheath secured onto said linked handlebar by a bolt, a transversal rod is transversally and separately coupled to both sides of said sheath, and both ends of said message belt are coupled with said two transversal rods respectively.

* * * * *